US010008830B2

(12) United States Patent
Marrs et al.

(10) Patent No.: US 10,008,830 B2
(45) Date of Patent: Jun. 26, 2018

(54) HIGH-VOLTAGE EXTENDER FOR CONNECTING A SPARK PLUG TO A HIGH-VOLTAGE SOURCE

(71) Applicant: MARSHALL ELECTRIC CORP., Rochester, IN (US)

(72) Inventors: Thomas C. Marrs, Rochester, IN (US); Donald Recupido, Argos, IN (US)

(73) Assignee: MARSHALL ELECTRIC CORP., Rochester, IN (US)

( * ) Notice: Subject to any disclaimer, the term of this patent is extended or adjusted under 35 U.S.C. 154(b) by 0 days. days.

(21) Appl. No.: 15/719,808

(22) Filed: Sep. 29, 2017

(65) Prior Publication Data

US 2018/0102630 A1 Apr. 12, 2018

Related U.S. Application Data

(63) Continuation-in-part of application No. 15/157,925, filed on May 18, 2016.

(51) Int. Cl.
*H01R 13/44* (2006.01)
*H01T 13/04* (2006.01)

(52) U.S. Cl.
CPC ..... *H01T 13/04* (2013.01)

(58) Field of Classification Search
CPC ..... H01R 13/53
USPC ..... 439/125; 313/136, 143
See application file for complete search history.

(56) References Cited

U.S. PATENT DOCUMENTS

| | | | | |
|---|---|---|---|---|
| 4,944,259 | A | 7/1990 | Richardson | |
| 5,060,624 | A | 10/1991 | Bruning et al. | |
| 5,357,233 | A * | 10/1994 | Wada | H01F 38/12 123/634 |
| 5,577,921 | A | 11/1996 | Philyaw et al. | |
| 5,685,282 | A | 11/1997 | Murata et al. | |
| 6,068,495 | A | 5/2000 | Virchow | |
| 6,340,303 | B2 * | 1/2002 | Hamada | H01R 13/2421 439/127 |
| 6,467,447 | B1 * | 10/2002 | Holmes | F02P 13/00 123/169 PA |
| 6,668,810 | B1 * | 12/2003 | St. John | F02P 3/02 123/634 |
| 6,817,872 | B1 * | 11/2004 | Berg | H01R 13/533 439/11 |
| 6,932,627 | B2 * | 8/2005 | Raff | H01T 13/04 439/125 |
| 7,594,489 | B1 * | 9/2009 | Marrs | H01T 13/04 123/143 C |

(Continued)

*Primary Examiner* — Peter G Leigh
(74) *Attorney, Agent, or Firm* — Egbert Law Offices, PLLC

(57) ABSTRACT

An extender for connecting a high-voltage source to a spark plug has a spring adapted to electrically connect with the high-voltage source and the spark plug, a tube having said spring positioned within an interior passageway thereof, and a boot affixed over an exterior of the tube. The boot is formed of a material having a rigidity less than a rigidity of a material of the tube. The boot has a first end adapted to be connected with the high-voltage source and a second end adapted to be connected to the spark plug such that the spring is in direct electrical connection with the spark plug and the high-voltage source. The tube has one end that is spaced inwardly of the first end of the boot and an opposite end of the spaced inwardly of the second end of the boot.

19 Claims, 5 Drawing Sheets

(56) References Cited

U.S. PATENT DOCUMENTS

| | | | | |
|---|---|---|---|---|
| 7,825,573 | B2 * | 11/2010 | Callahan | H01T 13/08<br>313/135 |
| 2013/0293332 | A1 * | 11/2013 | Skinner | H01F 27/02<br>336/90 |

* cited by examiner

HIGH-VOLTAGE EXTENDER FOR CONNECTING A SPARK PLUG TO A HIGH-VOLTAGE SOURCE

CROSS-REFERENCE TO RELATED APPLICATIONS

The present application is a continuation-in-part of U.S. patent application Ser. No. 15/157,925, filed on May 18, 2106, and entitled "Semi-Rigid High-Voltage Extender", presently pending.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to high-voltage extenders for connecting a high-voltage source way spark plug. More particularly, the present invention relates to extenders that are semi-rigid and which insulate a conductive member that is connected to an ignition coil at one end and a spark plug at an opposite end.

2. Description of Related Art Including Information Disclosed Under 37 CFR 1.97 and 37 CFR 1.98

Extenders are often used for the connection of high-voltage sources, such as ignition coils, to spark plugs. These high-voltage extenders are intended to pass the charge from the high-voltage source (having a maximum voltage of 43 KV) to the spark plugs. Typically, these extenders are suitably insulated so as to prevent tracking from the conductive rod to the ground created by the engine block.

FIG. 1 illustrates one example of a prior art high-voltage extender utilized and sold by Caterpillar, Inc. The high-voltage extender 10 has a machined stainless steel rod 12 that has a threaded end 14 and a connection end 16. The threaded end 14 is machined into the stainless steel rod 12 so as to connect into the female thread of the high-voltage connector of an ignition coil. The connection end 16 connects to the high-voltage terminal of a spark plug. A spring 18 is affixed to the connection end 16 of the stainless steel rod 12. The connection is accomplished by compressing the voluted spring 18 against the high-voltage terminal of the spark plug. The spring 18 is received within a stainless steel cup 20 which is attached to the stainless steel rod 12. The rod 12 is pressed into a machined sleeve 22 of polytetrafluoroethylene, otherwise known as TEFLON™. The sleeve 22 serves to insulate the stainless steel rod 12 from the electrical ground created by the ignition block. The sleeve 22 includes a first portion 22*a* and a second portion 22*b*. Portion 22*a* overlies the spark plug terminal receiving receptacle 28 and the stainless steel cup 20. The portion 22*b* of the sleeve 22 overlies a substantial length of the stainless steel rod 12.

As can be seen in FIG. 1, the sleeve 22 has a narrow diameter portion 24 overlying the threaded end 14 of the stainless steel rod 12. A main section 26 of the sleeve 22 extends along the rod 12 from the narrow diameter portion 24. The main section 26 has a greater diameter than the diameter of the narrow diameter portion 24. The sleeve 22 defines the receptacle 28 at the end opposite the narrow diameter portion 24. Receptacle 28, as recited hereinbefore, is suitable for receiving a portion of the spark plug therein. An O-ring seal 30 is received within a notch 32 formed in the interior wall of receptacle 28 at the end of the sleeve 22. The sleeve 22 has a constant diameter extending from the narrow diameter portion 24.

Experiments with the prior art of FIG. 1 have determined that during extended periods of high-voltage (30-40 KV), the voltage punctures the polytetrafluoroethylene sleeve at a point where the stainless steel cup 20 is nearest the high-voltage terminal of the spark plug. This occurs at an average of five to ten hours when a grounded metal sleeve is placed over the extender 10. During thermal cycling, the polytetrafluoroethylene expands and contracts lengthwise and creates a gap at the inner surface of the extender 10 and the insulating surface of the high-voltage connection of the ignition coil. This allows tracking along the surface to the electrical ground created by the engine block. During shipping, the extender 10 has a tendency to loosen. This also serves to create a gap at the area of the interface of the ignition coil and the extender 10. Additionally, the polytetrafluoroethylene material can "cold flow". This also can allow the extender to tend to loosen.

Additionally, the extender 10 of FIG. 1 has a large number of components. By utilizing a large number of components, there can be a tendency for the extender 10 to further fail. In practice, it has been found that, under certain circumstances, the stainless steel cup 20 can separate from the portion 22*a* of the sleeve 22. When the stainless steel cup 22 separates from the sleeve 22, several difficulties are encountered. It is often extremely tedious and difficult to remove the spark plug or to remove the stainless steel cup 20 from the spark plug after the cup has separated. This is because of the vast complexity of engines in which the extender 10 is used. Often, a specialized tool and skilled personnel are required so as to remove the spark plug and/or the stainless steel cup 20 when it becomes separated from the sleeve. In other circumstances, the O-ring seal 30 can separate from the notch 32. Once again, this can remain on the spark plug after the extender 10 is removed. This will also need to be removed from the spark plug before further action can be taken. Additionally, and furthermore, under certain circumstances, portion 22*a* can separate from portion 22*b*. Portion 22*a*, along with its interior components, would remain on the spark plug after the extender 10 is separated from the spark plug. Once again, several complex actions are required so as to remove these materials from the spark plug or to remove the spark plugs with these materials positioned thereon or thereover.

The variety of components that are used in the extender 10 add costs and inefficiencies in the production of the extender 10. In the manufacture of the extender 10, portion 22*a* will have to be joined a portion 22*b* of the sleeve 22. The stainless steel cup 20 will need to be fitted and fixed within the interior of the sleeve 22. The spring 18 will need to be captured within the cup 22 so as to be retained in a proper position for electrical connection to the spark plug. Furthermore, the O-ring seal 30 will need to be positioned and secured within the notch 32. As such, a need has developed so as to be able to reduce the number of components of the extender, along with costs and complexities of manufacture.

Engines that burn natural gas are becoming extremely popular. Natural gas produces low emissions very economically. Unfortunately, when spark plugs are used to ignite natural gas, they will have a very high temperature (of up to 250° C.). As such, the prior art high-voltage extenders would deteriorate rapidly over time when subjected to such temperatures. As such, a need has developed whereby the high-voltage extender can withstand the high temperatures of spark plugs of natural gas engines.

In the past, various U.S. patents have issued relating to such high voltage extenders. For example, U.S. Pat. No. 4,944,259, issued on Jul. 31, 1990 to R. D. Richardson, teaches an ignition system with an insulated and extendable extender. This extender resiliently biases the extender between the source of high energy and the spark plug to provide a positive and reliable electrical connection therebetween. The extender is of a relatively rigid construction so as to prevent bending. The extender is combined with a shield in the engine to further protect and increase the functional life of the components.

U.S. Pat. No. 5,060,624, issued on Oct. 29, 1991 to Bruning et al., provides an engine ignition system that has a transformer assembly and positioning means. The transformer assembly has an elongated body having a cup portion containing the coils, a base portion, and a stem portion. A conducting core extends through the stem and base portions. A suitable clip connects the core electrically to a spark plug installed in a profiled bore of the cylinder head. A positioning device is provided to positively align and contain the transformer assembly within a valve mechanism compartment defined between the cover and the cylinder head. A spring member connected to the cup portion. Depending guide members formed within the cover cooperate with each other.

U.S. Pat. No. 5,357,233, issued on Oct. 18, 1994 to Z. Wada, teaches an extension device which extends from the ignition coil to supply the peak high-voltage output to a spark plug. A part of an outer periphery of the secondary coil at an intermediate position of the outer periphery of the secondary coil sinks in relation to the other part of the outer periphery of the secondary coil to form a groove extending in a radial direction of the secondary coil. The peak high-voltage output is transmitted from the secondary coil through the groove to the extension device. The extension device includes a first member extending from the ignition coil, a second member for being connected to the spark plug, and an elastic member connecting the first member to the second member so that the first member moves elastically in relation to the second member.

U.S. Pat. No. 5,577,921, issued on Nov. 26, 1996 to Philyaw et al., discloses an electrical connector system for electrically connecting a voltage source to a spark plug terminal. This transformer assembly has an elongate body including a cup portion containing primary and secondary coils, a base portion, and a stem that is adapted to be installed in a housing of a cylinder head. An electrical source extends through the stem and base portion. An electrical connecting system includes an electrical conductor adapted to receive the voltage source with a spring contacting the end of a spark plug terminal biasing the conductor in a direction away from the spark plug. The electrical connector system further includes a positioning device adapted to positively align and contain the transformer assembly within a valve mechanism compartment defined between a cover and the cylinder head. A spring member is connected to the cup portion so as to axially bias the electrical conductor in a direction toward the spring in contact with the spark plug terminal so as to ensure an electrical connection.

U.S. Pat. No. 5,685,282 issued on Nov. 11, 1997 to Murata et al., discloses an ignition device for an internal combustion engine. This ignition device has a spark plug including a high voltage terminal, an ignition coil for generating a high voltage, and adapter assembly for electrically connecting the ignition coil to the high voltage terminal of the spark plug. The adapter assembly has a support sleeve for accommodating and supporting the high voltage terminal of the spark plug against a transverse movement of the high voltage terminal. The support sleeve is either a continuous extension or a metal tube of the adapter assembly. The assembly may also include a wear-resistant material.

U.S. Pat. No. 6,068,495, issued on May 30, 2000 to F. Virchow, discloses a spark plug for an internal combustion engine. A connector sleeve is formed of an insulating material. An elastic member is connected to the connector sleeve so as to seal the gap between the connector sleeve and a spark plug well. A ceramic inlet is formed in the connector sleeve so as to enclose the plug-in contact and the ignition cable connection.

U.S. Pat. No. 6,340,303, issued on Jan. 22, 2002 to Hamada et al., describes a high tension connection for the spark plug of an internal combustion engine. This connection portion has a first high tension connection terminal, a second high tension connection terminal for electrically connecting with the first high tension connection terminal, a locking mechanism provided between the first high tension connection terminal and the second high tension connection terminal for restricting the separation therebetween in the axial direction, and a spring member disposed between the first high tension connection terminal and the second high tension connection terminal. This device serves to prevent an instantaneous breakdown of the connection if an external force is applied to the high tension portion.

U.S. Pat. No. 6,817,872, issued on Nov. 16, 2004 to S. M. Berg, describes a heat-protective spark plug extension. The extender includes an elongated body formed of heat resistant and electrically insulative material that extends between a spark plug engagement end and a spark plug wire connector end. A conductor is located within the body and includes a fitting adapted to releasably electrically connect to a spark plug wire. A receptacle is adapted for electrical connection to a spark plug. An adjustment part permits adjustable movement of the spark plug wire connector end relative to the conductive receptacle.

U.S. Pat. No. 7,594,489, issued on Sep. 29, 2009 to the present Applicant, describes a high-voltage extender for connecting a high-voltage source to a spark plug. The extender has a conductive rod with one end suitable for electrical connection to the high-voltage source and a second end suitable for electrical connection to the spark plug. A sleeve is injection-molded over the conductive rod so as to be in void-free relation with an exterior surface of the conductive rod. The conductive rod has a first end extending outwardly therefrom. The sleeve defines a spark plug-receiving receptacle at the second end of the conductive rod. An O-ring is received in a notch formed adjacent to the first end of the conductive rod. Another O-ring is received in a notch formed around the inner wall of the receptacle. A spring is affixed to the second end of the conductive rod.

It is an object of the present invention to provide an extender that provides semi-rigidity in the connection between a high-voltage source and a spark plug.

It is another object of the present invention to provide an extender that allows for slight angular misalignment between the high-voltage source and the spark plug.

It is another object of the present invention to provide an extender that does not compromise the dielectric integrity at the seal with the spark plug.

It is another object of the present invention to provide an extender that prevents high-voltage tracking.

It is another object of the present invention to provide an extender that can withstand voltage that is in excess of 36 kV.

It is still further object of the present invention to provide a high-voltage extender that avoids radial deflection of the spring/conductive connection with the spark plug.

It is a further object of the present invention provide an extender which is resistant to the corona created in the engine block.

It is still a further object of the present invention to provide an extender that is easy to manufacture, easy to install and use, and relatively inexpensive.

It is a further object of the present invention to provide an extender that can withstand high-temperature conditions, such as those produced by natural gas engines.

It is a further object of the present invention to provide an extender which avoids the unintended separation of components.

It is a further object of the present invention to provide an extender that has a minimal number of components.

It is a further object of the present invention to provide an extender which avoids costly and time-consuming repair associated with the separation of components from the extender.

It is still a further object of the present invention to provide an extender that can be easily manufactured with a minimal cost.

These and other objects and advantages of the present invention will become apparent from a reading of the attached specification and appended claims.

BRIEF SUMMARY OF THE INVENTION

The present invention is an extender for connecting high-voltage source to a spark plug. The extender comprises a spring adapted to electrically connect with the high-voltage source and the spark plug, a tube having the spring positioned in an interior passageway thereof, and a boot affixed over an exterior of the tube. The boot is formed of a material having a rigidity less than a rigidity of a material of the tube. The boot has a first end adapted to connect with the high-voltage source and a second end adapted to be connected to the spark plug such that the spring is an electrical connection with the spark plug and the high-voltage source.

In the present invention, the spring has one end abutting an outer end of the tube. This end of the spring will be in electrical connection with the high-voltage source. This end of the spring is of a greater diameter than a diameter of the remainder of the spring. The spring has a greater coil density at the ends thereof than in the middle area thereof.

The boot is entirely integrally formed of a rubber or polymeric material. The tube is of a rigid material. The tube has one end that is spaced longitudinally inwardly of the first end of the boot and an opposite end spaced longitudinally inwardly of the second end of the boot. Each of the first and second ends of the boot have no structures affixed therein or thereto. In the preferred embodiment present invention, the spring is a single spring, the tube is a single tube, and the boot is a single boot.

The present invention is also an ignition system that comprises a high-voltage source, a spark plug, a spring having one end electrically connected to the high-voltage source and an opposite end electrically connected to the spark plug, a tube having an interior passageway in which the spring has at least a portion positioned in this interior passageway, and a boot affixed over an exterior of the tube. The boot has a first end connected to the high-voltage source and an opposite end connected to the spark plug.

In this ignition system, the spring has one end abutting an outer end of the tube. This end of the spring will be an electrical connection with the high-voltage source. This end of the spring is of a greater diameter than a diameter of a remainder of the spring. The spring has a greater coil density at this end of the spring and a lesser coil density in a middle area of the spring. The spring also has a greater coil density at the opposite end of the spring which is connected to the spark plug.

In this ignition system, the boot is entirely integrally formed of a rubber or polymeric material. The first end of the boot has no structure interposed between the first end of the boot and the high-voltage source. Similarly, the second end of the boot has no structures interposed between the second end of the boot and the spark plug. In the preferred embodiment of the ignition system of the present invention, the spring is a single spring, the tube is a single tube, and the boot is a single boot. The tube is of a rigid material. The tube has one end that is spaced longitudinally inwardly of the first end of the boot and an opposite end spaced longitudinally inwardly of the opposite end of the boot.

The foregoing Section is intended to describe, with particularity, the preferred embodiments of the present invention. It is understood that modifications to these preferred embodiments can be made within the scope of the present claims. As such, this Section should not to be construed, in any way, as limiting of the broad scope of the present invention. The present invention should only be limited by the following claims and their legal equivalents.

DETAILED DESCRIPTION OF THE INVENTION

Figure 2:
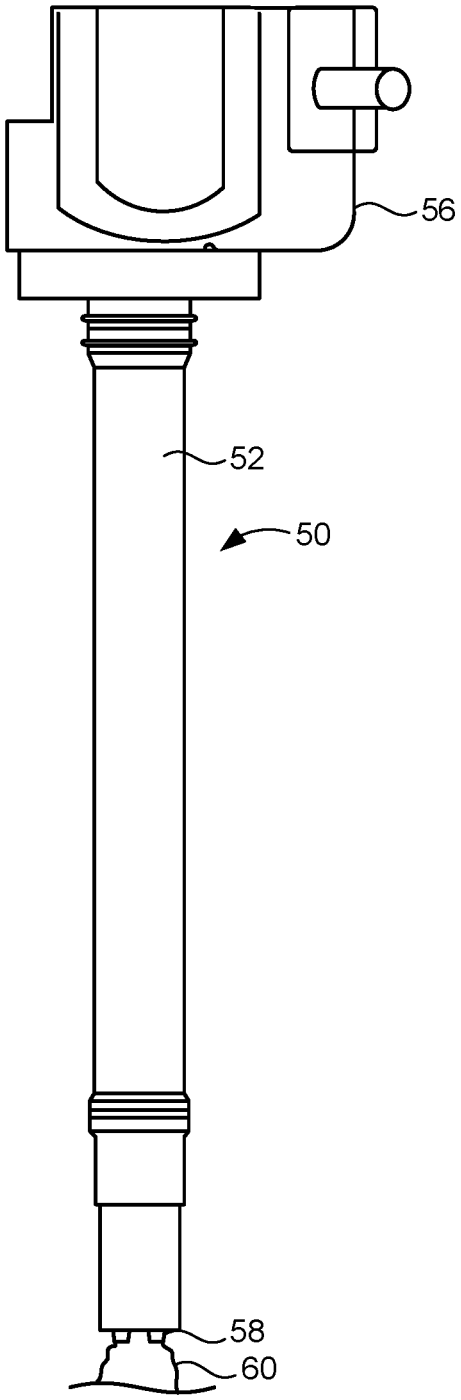
FIG. 2 is a side elevational view showing the extender of the present invention as secured to a high-voltage source and to a spark plug.

Referring to FIG. 2, there shown the high-voltage extender 50 in accordance with a first embodiment of the present invention. The high-voltage extender 50 is a longitudinal member that has a boot 52 extending over the exterior surface of a conductive member. In particular, the boot 52 has a connector 54 at one end thereof. Connector 54 is illustrated as connected to a high-voltage source 56, such as an ignition coil. The boot 52 has an opposite end 58 that is adapted to connect with a terminal 60 of a spark plug. The high-voltage extender 50 is intended to transmit electrical energy from the high-voltage source 56 to the terminal 60 of the spark plug.

Figure 3:
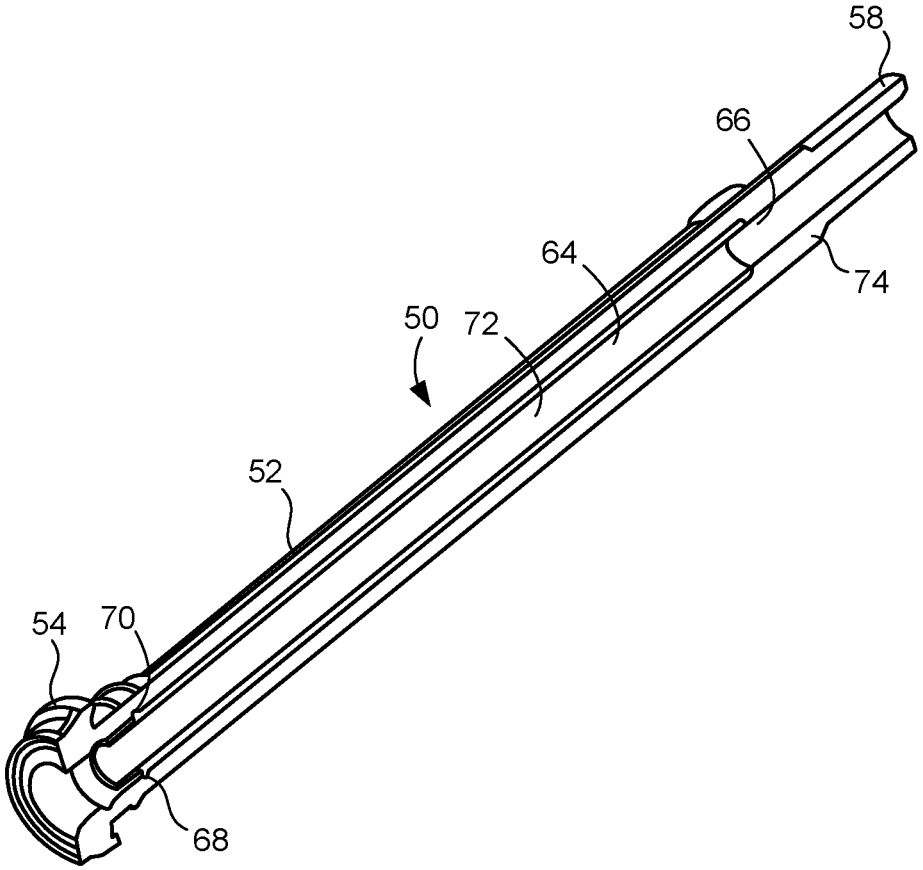
FIG. 3 is a cross-sectional view, in perspective, of the extender in accordance with the present invention.

FIG. 3 illustrates a cross-sectional view of the first embodiment of the extender 50 of the present invention with the conductive member omitted. In particular, it can be seen that the extender 50 has the boot 52 extending longitudinally with a connector 54 at one end and a connector 58 at an opposite end thereof.

In FIG. 3, there is a tube 64 that is affixed within the interior of the boot 52. The tube 64 can be inserted into the interior passageway 66 of the boot 52 or the boot 52 can be over-molded onto the tube 64 such that there are no voids between the exterior of tube 64 and the interior of boot 52. As can be seen, the tube 64 extends for a portion of the length of the interior 66 of the boot 52. The tube 64 includes a protrusion 68 adjacent to the connector 54 which is received within an annular notch 70 formed in the inner wall of the boot 52. The tube 64 also has an interior passageway 72 into which the conductive member is received.

Importantly, in the present invention, the tube 64 will have a rigidity that is greater than the rigidity of the boot 52. In particular, the boot 52 can be formed of an MS115 silicone rubber material. The tube 64 can be formed of a PET RE5329 material or a liquid crystal polymer material. As such, the tube 64 will provide rigidity to the silicone rubber material of the boot 52 for a substantial portion of the length of the boot 52. However, the outwardly extending end portion 74 of the boot 52 can be semi-flexible so as to compensate for slight angular misalignment between the high-voltage source 56 and the terminal 60 of the spark plug. The rigidity of the tube 64 will serve to protect the conductive member so as to avoid radial deflection of the conductive member.

Figure 4:
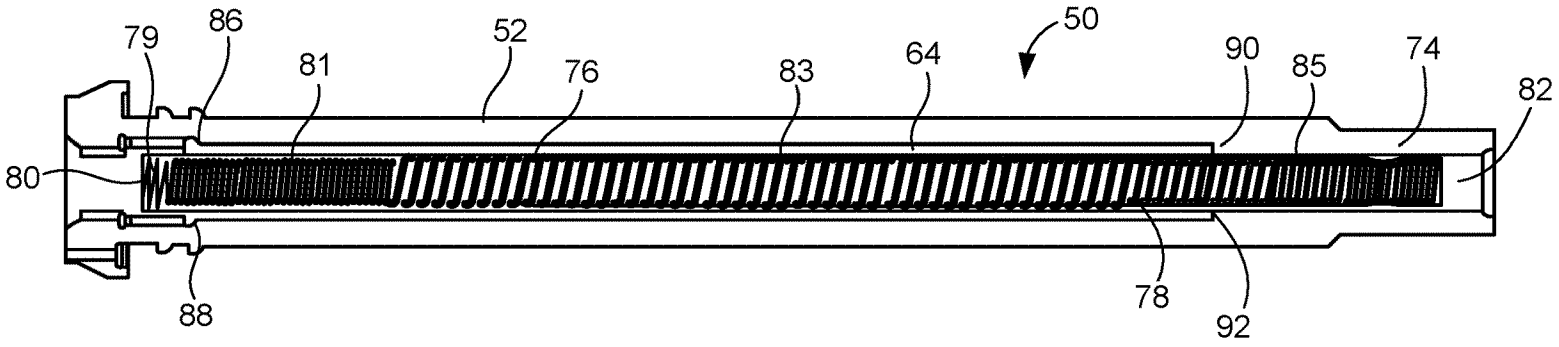
FIG. 4 is a cross-sectional view of the extender of the present invention showing the placement of the spring within the interior of the extender.

FIG. 4 is a cross-sectional view of the extender 50. In FIG. 4, the conductive member 76 is illustrated as received within the tube 64 and within the interior of the boot 52. The conductive member 76 includes a spring 78 that extends from an end 80 to an end 82. End 80 is suitable for connection to a terminal of the high-voltage source 56. The end 82 is suitable for contacting the terminal 60 of the spark plug. The spring 78 is tightly positioned within the interior passageway of the tube 64 such that the tube 64 prevents radial deflection of the spring 78. However, the flexible end portion 74 of the boot 52 can suitably deflect, along with the spring contained therein. Once again, the interior diameter of the boot 52 in the area adjacent to the spring 78 near end 82 will be very close so as to further avoid radial deflection of the spring 78. Whenever the end 80 contacts the terminal of the high-voltage source 56 and the end 82 connects with the terminal 60 of the spark plug, an electrically conductive connection is achieved between the high-voltage source 56 and the spark plug. The spring 78 is preferably formed of Stainless Steel 304 material.

In FIG. 4, it can be seen that the inner wall of the boot 52 has an internal shoulder 86. The end of the tube 64 includes an annular flange 88. Annular flange 88 abuts the internal shoulder 86 so as to secure the position of the tube 64 within the boot 52. There is also another internal shoulder 90 formed on the inner wall of the boot 52. The end 92 of the tube 64 is securely abutted against the internal shoulder 90. Once again, this further serves to fix the position of the tube 64 within the boot 52.

The polymeric tube 64 provides the necessary rigidity to the extender 50 during installation onto the spark plug. The semi-rigid nature of the extender 50 also allows for slight angular misalignment to the spark plug without compromising the dielectric integrity of the sealing at the spark plug. The special overlapping connection is designed prevent high-voltage tracking and withstand voltages in excess of 36 KV. The spring 78 is contained internal of the tube 64 so as to offer dielectric strength and a means for minimizing the radial deflection of the spring.

In FIG. 4, the spring 78 has an end 79 abutting an outer end of the tube 64. This arrangement is shown in greater detail in FIG. 6. This end 79 is adapted to be an electrical connection with the high-voltage source. It can be seen that this end 79 has a diameter greater than the diameter of the remainder of the spring. As such, will provide a greater surface area for connecting to the terminal of the high-voltage source and further establish a proper electrical connection by being compressed against the rigid end of the tube 64. The spring 78 has an area 81 of greater coil density than a middle area 83 of spring 78. This area 81 of greater coil density is adjacent to the end 79 of the spring 76. Similarly, there is another area 85 of greater coil density adjacent to the end 82 of spring 78. The coil density in area 85 will be greater than the coil density of the middle area 83. These regions of greater coil density offers several advantages. First, the greater coil density is located in the area of the largest electrical flux in the ignition system. This would be at the connection of the spring 78 and the high-voltage source and the connection of the spring 78 to the high-voltage terminal of the spark plug. Furthermore, the greater coil density enhances the electrical connection at the ends 79 and 82 of the spring 78 with a respective high-voltage source and the spark plug. Furthermore, area 85 of greater coil density will add a small amount of extra rigidity to the boot 52 at the end portion 74 of boot 52.

Figure 1:
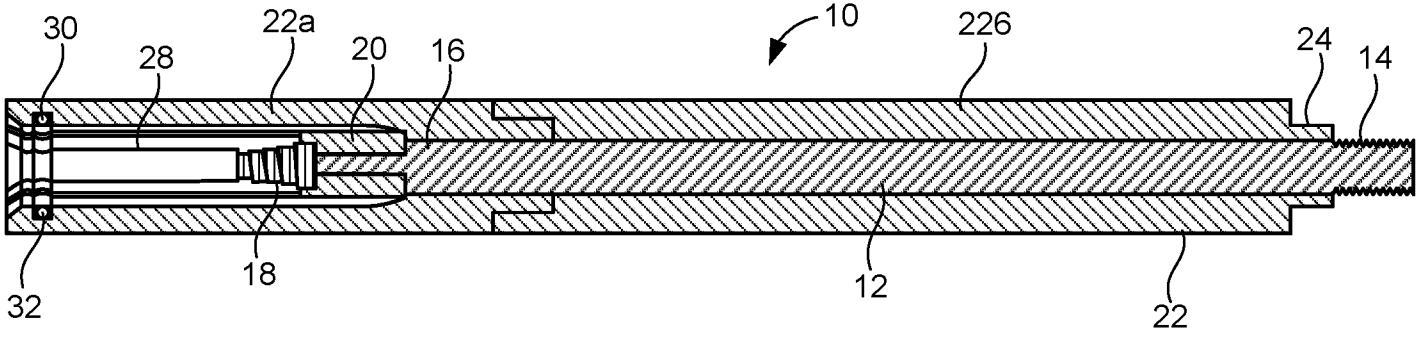
FIG. 1 Prior Art
FIG. 1 is a cross-sectional view of a prior art extender.

The boot 52 is entirely integrally formed of a rubber or polymeric material. As such, there is no connection between separate portions of the boot. The entire boot is formed the in a molding process. As such, there would be no possibility of separation of portions of the boot 52 as the prior art of FIG. 1.

Importantly, unlike the prior art, the present invention does not utilize the stainless steel cup 20 at the high-voltage source receiving end of the boot 52. The formed interior structure of the boot at this end will properly secured to the terminal of the high-voltage source. The wide diameter end 79 of the spring 78 will properly establish the electrical connection between the spring 78 and the terminal of the high-voltage source without the need of a stainless steel cup. As such, there would be no structure in this end of the boot that could separate and remain on the spark plug after the extender 50 is removed. Similarly, the formed interior structure of the boot 52 can have an integral O-ring seal that will not separate onto the terminal of the high-voltage extender. Similarly, the end 74 of the boot 52 will have no structures that are interposed between the terminal of the spark plug and the end 82 of the spring 78.

In FIG. 4, there is only a single spring 78, a single boot 52, and a single tube 64. As such, the entire extender of the present invention is made up of just three pieces. This reduces manufacturing costs and procedures substantially and avoids the use of components that can separate.

Figure 5:
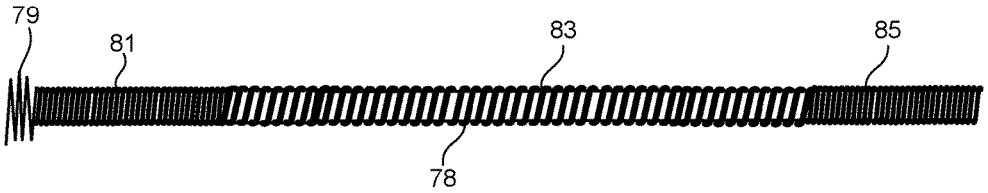
FIG. 5 is a side elevational view of the spring as used in the high-voltage extender of the present invention.

FIG. 5 shows an isolated view of the spring 78. As can be seen, the end 79 of the spring 78 has a diameter greater than a diameter of the remainder of the spring 78. The area 81 of spring 78 has a greater coil density than the middle area 83 of spring 78. Similarly, the area 85 of spring 78 will have a greater coil density than that of the middle area 83. The wide diameter end 79 of spring 78 achieves certain unique purposes. First, it provides an area that can abut the outer end of the tube so as to cause the spring 78 to be fixed in position within the tube 64. Furthermore, the wide diameter end 78 provides a larger area of surface contact with the terminal of the high-voltage source so as to enhance the electrical connection thereto.

Figure 6:
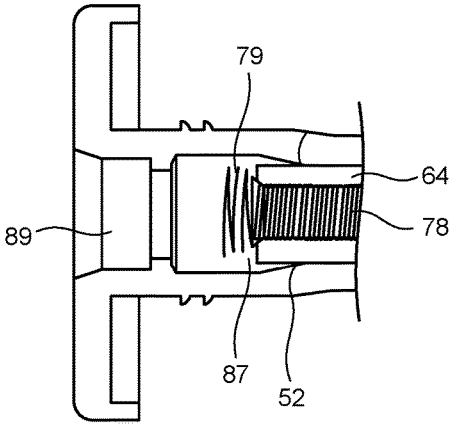
FIG. 6 is a detailed view showing the configuration of the interior of the high-voltage extender of the present invention at the high-voltage source.

FIG. 6 shows this arrangement in further detail. It can be seen that the wide diameter end 79 of the spring 78 abuts the end 87 of the tube 64. This end 79 will face the end 89 of the boot 52. This end 89 of the boot 52 serves to receive the terminal of the high-voltage source.

The surface between the high-voltage connection of the ignition coil and the extender seals this interface and prevents high-voltage leakage. Since the tube is injection-molded as an insert on the boot, the tube cannot move within the boot rotationally or lengthwise. This keeps the surface of the extender at the ignition coil and the prevents high-voltage leakage at this point. The materials used in the extender of the present invention are more resistant to the corona created in the engine block. During testing, the extender of the present invention achieves a longer period of use without failure compared to the extender of the prior art. Experiments conducted with the high-voltage extender of the present invention shows that the extender is able to withstand temperatures of up to 200° C. As such, the high-voltage extender is particularly useful in association with natural gas engines.

The foregoing disclosure and description of the invention is illustrative and explanatory thereof. Various changes in the details of the illustrated construction can be made within the scope of the present claims without departing from the true spirit of the invention. The present invention should only be limited by the following claims and their legal equivalents.

We claim:

1. An extender for connecting a high-voltage source to a spark plug, the extender comprising:

a spring adapted to electrically connect with the high-voltage source and the spark plug;

a tube having an interior passageway, said spring having at least a portion positioned in said interior passageway of said tube, said spring having a one end abutting an end of said tube and said one end having an outer diameter greater than an inner diameter of said tube; and a boot affixed over and exterior of said tube, said boot being formed of a material having a rigidity less than the rigidity of a material of said tube, said boot having a first end adapted to connect with the high-voltage source and a second end adapted to be connected to the spark plug such that said spring is in electrical connection with the spark plug and the high-voltage source.

2. The extender of claim 1, wherein said one end of said spring is adapted to be in electrical connection with said high-voltage source.

3. The extender of claim 1, wherein said one end of said spring is of a greater diameter than a diameter of a remainder of said spring.

4. The extender of claim 1, wherein said spring has a greater coil density adjacent one end of said spring and a lesser coil density at a middle area of said spring.

5. The extender of claim 4, wherein said spring has the greater coil density at each end of said spring.

6. The extender of claim 1, wherein said boot is entirely integrally formed of a rubber or a polymeric material.

7. The extender of claim 1, wherein said tube is of a rigid material, said tube having one end that is spaced longitudinally inwardly from said first end of said boot and an opposite end that is spaced longitudinally inwardly from said second end of said boot.

8. The extender of claim 1, wherein said spring extends longitudinally through an interior of said boot, said tube overlying substantially all of said spring.

9. The extender of claim 1, wherein each of said first and second ends of said boot has no structures affixed therein or thereto.

10. The extender of claim 1, wherein said spring is a single spring, said tube being a single tube, said boot being a single boot.

11. An ignition system comprising:

a high-voltage source;

a spark plug;

a spring having one end directly electrically connected to said high-voltage source and an opposite end directly electrically connected to said spark plug;

a tube having an interior passageway, said spring extending entirely through said interior passageway of said tube; and a boot affixed over and exterior of said tube, said boot having a first end connected to said high-voltage source and opposite end connected to said spark plug.

12. The ignition system of claim 11, wherein said spring has one end abutting an outer end of said tube.

13. The ignition system of claim 11, wherein one end of said spring is of a greater diameter than then a diameter of a remainder of said spring.

14. The ignition system of claim 11, wherein said spring has a greater coil density adjacent one end of said spring and a lesser coil density in a middle area of said spring.

15. The ignition system of claim 11, wherein said boot is entirely integrally formed of a rubber or polymeric material.

16. The ignition system of claim 11, wherein said spring extends longitudinally through an interior of said boot, said tube overlying a substantial portion of said spring.

17. The ignition system of claim 11, wherein said first end of said boot has no structures interposed between said boot and said high-voltage source, said opposite end of said boot having no structures interposed between said opposite end of said boot and said spark plug.

18. The ignition system of claim 11, wherein said spring is a single spring, said tube being a single tube, said boot being a single boot.

19. The ignition system of claim 11, wherein said tube is of a rigid material, said tube having one end that is spaced longitudinally inwardly of said first end of said boot and an opposite end that is spaced longitudinally inwardly from said opposite end of said boot.

* * * * *